United States Patent [19]

Lichtenberg

[11] Patent Number: 4,862,560

[45] Date of Patent: Sep. 5, 1989

[54] IRREVERSIBLE TIE STRAP WITH SPECIALIZED CLASP TO PERMIT THE STRAP TO BE INSERTED THROUGH THE CLASP TWICE

[75] Inventor: Jose Lichtenberg, Mexico City, Mexico

[73] Assignee: Designs by Master Markets, Inc., Sherman Oaks, Calif.

[21] Appl. No.: 299,837

[22] Filed: Jan. 23, 1989

[51] Int. Cl.[4] ..... B65D 63/00

[52] U.S. Cl. ..... 24/16 PB; 24/17 AP; 24/30.5 P

[58] Field of Search ..... 24/16 PB, 17 AP, 30.5 P; 292/311, 317, 318, 319, 320, 321, 322, 323; 248/74.3

[56] References Cited

U.S. PATENT DOCUMENTS

| | | | |
|---|---|---|---|
| 2,262,840 | 11/1941 | Gibson et al. . | |
| 3,292,961 | 12/1966 | Moberg . | |
| 3,744,096 | 7/1973 | Kok | 24/16 PB |
| 3,747,164 | 7/1973 | Fortsch | 24/16 PB |
| 4,377,887 | 3/1983 | Valestin | 24/16 PB |
| 4,498,507 | 2/1985 | Thompson | 24/30.5 P |
| 4,543,691 | 10/1985 | Calmettes | 24/20 EE |
| 4,574,434 | 3/1986 | Shupe et al. | 24/30.5 P |
| 4,665,588 | 5/1987 | Nakano | 24/16 PB |
| 4,680,834 | 7/1987 | Andre et al. | 24/16 PB |

FOREIGN PATENT DOCUMENTS

| | | | |
|---|---|---|---|
| 1351174 | 12/1963 | France | 24/16 PB |
| 1471561 | 3/1967 | France . | |

*Primary Examiner*—Victor N. Sakran
*Attorney, Agent, or Firm*—Thomas I. Rozsa

[57] ABSTRACT

An irreversible tie strap in which the tieing strap comes in a roll including an elongated strap member having a multiplicity of holes, grooves or slots therein to accommodate a pair of mating tongues. The strap in roll form can be cut to any desired length, thereby facilitating an efficient strap which can be produced in a single mold and which can be cut to any desired length. Included in the present invention irreversible tie strap is a separate clasp member which includes a separating internal partition wall and a pair of oppositely disposed internally protruding tongues extending in the direction of the internal separating wall. The elongated strap member can be inserted through the separate clasp on either side of the partition wall such that the two ends of the elongated strap member can be pulled in the same direction and thereby create a loop which can be tightened to any desired loop size including a very small loop which is almost flush with the clasp. The pair of internally protruding tongues each permit the section of strap on its side of the internal partition wall to pass through the clasp member until the desired loop size is achieved and then the pair of internally protruding tongues can accommodate any desired two holes or openings in the strap and thereby irreversibly lock the strap in place inside the clasp through the tongue and groove arrangement.

18 Claims, 1 Drawing Sheet

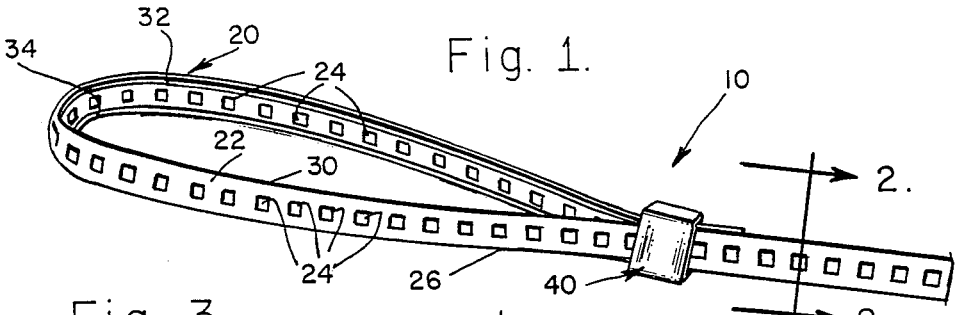
Fig. 1.
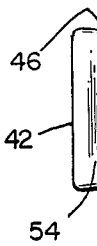
Fig. 3.
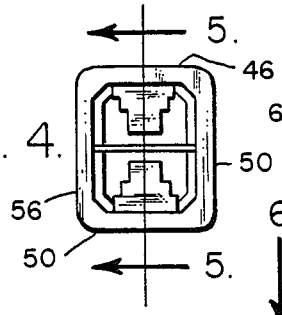
Fig. 4.
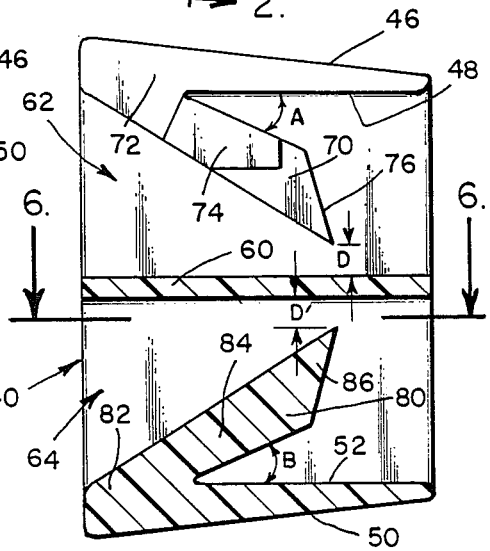
Fig. 5.
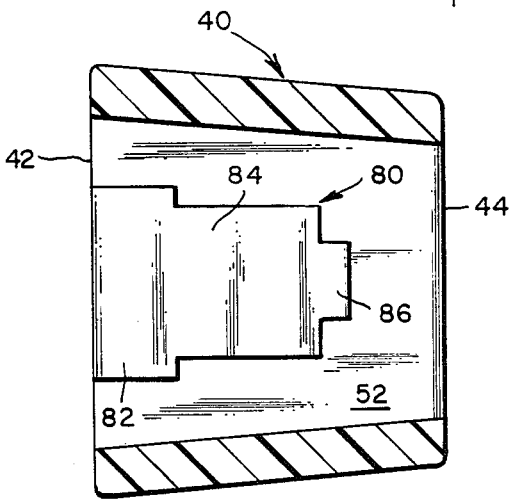
Fig. 6.
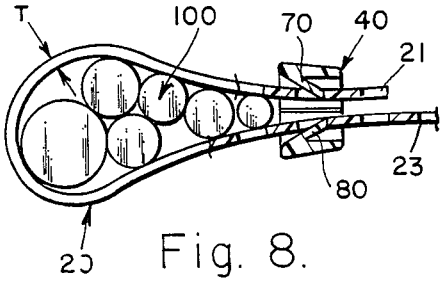
Fig. 8.
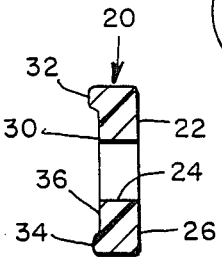
Fig. 2.
Fig. 7.
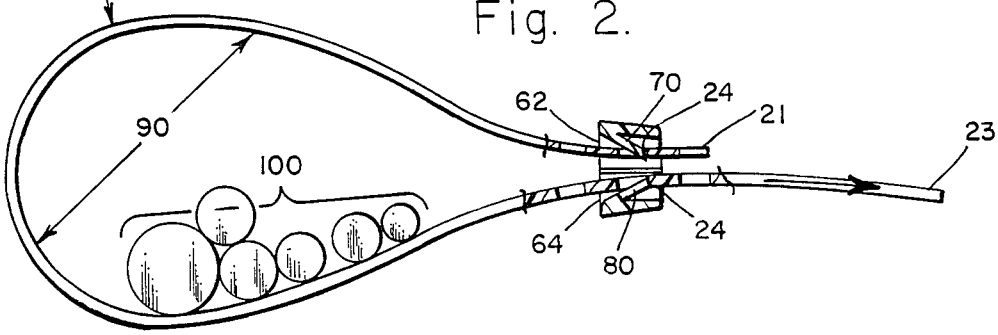

IRREVERSIBLE TIE STRAP WITH SPECIALIZED CLASP TO PERMIT THE STRAP TO BE INSERTED THROUGH THE CLASP TWICE

BACKGROUND OF THE INVENTION

1. Field of the Invention

The present invention relates to apparatus such as fastening means which can tie up things such as cables, wires etc. in a manner by which the fastening means is locked in place to secure the objects together and such that the fastening means cannot be released without being permanently cut. The present invention further relates to the field of flexible ties which are produced in a continuous roll and can be adjusted to any multiplicity of desired lengths. The present invention also relates to the incorporation of a novel locking member to be used in conjunction with the continuous strip to permit the strip to be inserted through the clasp twice and drawn into a very small locking loop to facilitate the smallest tieing requirements.

2. Description of the Prior Art

In general, flexible tie apparatus have been known in the prior art. One type of flexible tie known in the prior art involves the creation of a specific flexible strap with a clasp incorporated into the strap at one end. This type of tie is interjected into a whole component of clasp and strap and is made of thermoplastic materials. While this device serves a function similar to the present invention, a major problem with this prior art embodiment is that each different length requires a separate mold. Each strap can only be made to a specific desired length and therefore a separate mold must be made for each strap. Excessive lengths cannot be contrived. Therefore, only generally commercial lengths are produced and it is not possible for the consumer to have specialized lengths created. As a result, there is a lot of waste of material which is discarded when excessive lengths are used for smaller tie applications. In addition, from a manufacturing standpoint, it is necessary to have numerous different molds and manufacturing processes to produce the various sized ties.

A Japanese product involves the production of ties in automatic form. A continuous monofilament of plastic material is hurled around the object to be tied. The production process further involves the production of a special knot which thermofastens the monofilament and cuts the excess. This monofilament is a continuous strip of material and is not in the form of a tie with either projecting tongues or a multiplicity of holes to receive tongues.

Several prior art patents are also known which involve various types of tie arrangements.

1. U.S. Pat. No. 2,262,840 issued to Gibson et al in 1941 for "Car Sealing Device" discloses a sealing device made of metal where the flexible strap includes a multiplicity of tongues which are pulled through and locked in place inside an end sleeve. The concept is that the strap can be pulled as small as possible so that no one can easily cut the tie. The tongues on the strap also lock within the sleeve so as to make it irreversible. The locking means is integral with the strap and therefore only specific lengths are achieved with each mold produced.

2. U.S. Pat. No. 4,680,834 to Andre et al in 1987 for "Cable Tie" discloses a flexible plastic strap which can come in various lengths and in a roll. The locking member requires that one end of the strap be guided through the locking member and after the strap is wound around the given object, the strap is pulled through the locking member in the opposite direction and is locked in place. The locking mechanism of this apparatus requires that the strap be pulled in both directions and is a cumbersome design by which the straps can come loose. In addition, the strap in the Andre design includes tongues which must be caught in pockets in the clasp. It is easy for the tongues to break off as they are run through the clasp and thereby create a significant design flaw in this device. In addition, the two sides of the strap are in contact with each other and it is easy for them to slip relative to each other and cause the tie to become loose.

3. U.S. Pat. No. 3,292,961 issued to Moberg in 1966 for "Bag Seal" discloses a tie strap for sealing a bag.

4. U.S. Pat. No. 4,543,691 issued to Calmettes in 1985 discloses a hose clamp apparatus.

5. French Patent No. 1,471,561 issued in 1966 discloses a tieing device where the locking members are protruding projections.

Therefore, while flexible tieing devices have been known in the prior art, none of them combine the creation of a continuous roll of flexible material combined with a specialized interiorly toothed locking mechanism wherein the locking mechanism is a separate piece which includes a pair of oppositely directed protruding tongues in the clasp which permit the flexible strip having a multiplicity of openings to be pulled through the clasp twice to thereby provide a means to tighten the strip into as small a loop as required to tie any object no matter how small, and further is secured through a tongue and groove arrangement so as to become irreversible,. There is a significant need for such an apparatus in order to enable a user to accommodate any multiplicity of tieing situations of various thickness and radius with a single endless flexible tie strap that can be irreversibly locked around the object to be tied.

SUMMARY OF THE PRESENT INVENTION

The present invention relates to a novel irreversible tie strap in which the tieing strap comes in a roll including an elongated strip member having a multiplicity of holes, grooves or slots therein to accommodate a pair of mating tongues. The strap in roll form can be cut to any desired length, thereby facilitating an efficient strap which can be produced in a single mold and which can be cut to any desired length. Included in the present invention irreversible tie strap is a separate clasp member which includes a separating internal partition wall and a pair of oppositely disposed internally protruding tongues extending in the direction of the internal separating wall. The elongated strip member can be inserted through the separate clasp on either side of the partition wall such that the two ends of the elongated strip member can be pulled in the same direction and thereby create a loop which can be tightened to any desired loop size including a very small loop which is almost flush with the clasp. The pair of internally protruding tongues each permit the section of strap on its side of the internal partition wall to pass through the clasp member until the desired loop size is achieved and then the pair of internally protruding tongues can accommodate any desired two holes or openings in the strap and thereby irreversibly lock the strap in place inside the clasp through the tongue and groove arrangement.

The present invention consists of supplying a continuous strip of material which may be metallic or thermoplastic, and which includes openings, to which a clasp with a pair of unidirectional grippers or tongues is attached. As a result, only one mold need be produced and the strap can be made in roll length in order to reduce the necessity of production of numerous straps of different lengths. Therefore, waste is considerably reduced.

It has been discovered, according to the present invention, that if a flexible strap member is created in a continuous strip, then any desired length of flexible strap member can be obtained by merely sizing the flexible strap member to fit the object to be tied and then cutting the strap member to length, which length is sufficient to accommodate the closing clasp member.

It has further been discovered, according to the present invention, that if the closing clasp member comprises a housing separated by an internal partition wall and further comprises pair of flexible gripping members each of which is affixed to the internal surface of opposite external walls of the gripping member and oriented at a downward angle toward the internal partition wall and stopping at a distance sufficient to permit the flexible strap to pass between the tip of the flexible gripping member and the internal partition wall, then the clasp member can retain the flexible strap member in an irreversible manner by locking a flexible gripping member into one of the grooves or openings in the flexible strap member on each side of the internal partition wall.

It has also been discovered, according to the present invention, that if the flexible clasp member comprises inwardly slanted gripping members with each being in the form of a stem with a pointed end, then the flexible strap member with mating openings can be quickly and efficiently locked in place by simply being pulled through the clasp member until the desired location is reached.

It is therefore an object of the present invention to provide a flexible tie strap which can be used to bundle objects, fasten objects together, attach one object to another and perform any multiplicity of fastening and tieing operations wherein the length of the tieing strap can be adjusted to any desired size.

It is a further object of the present invention to provide a flexible tieing strap with a specialized clasp that permits the flexible tieing strap to be threaded through the clasp twice in a manner such that the strap is wound back on itself to form a tieing loop which can be formed in any desired size and further locks the strap at two locations in an irreversible manner through a simple and effective locking mechanism.

It is another object of the present invention to provide a flexible tieing strap which can be made of plastic or thermoplastic material, metal, or any other desired material.

It is an additional object of the present invention to provide a flexible locking strap which can be manufactured in any desired width and thickness in addition to any desired length.

It is also an object of the present invention to provide a flexible locking strap which can be produced in a roll and dispensed from a cartridge or other suitable dispensing apparatus.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of the present invention flexible tie strap with the strap locked within the specialized clasp after being formed into a tieing loop.

FIG. 2 is a cross-sectional view taken along line 2—2 of FIG. 1.

FIG. 3 is a side elevational view of the specialized clasp of the present invention.

FIG. 4 is a rear elevational view of the specialized clasp of the present invention.

FIG. 5 is a cross-sectional view taken along line 5—5 of FIG. 4.

FIG. 6 is a cross-sectional view taken along line 6—6 of FIG. 5.

FIG. 7 is a side elevational view of the present invention flexible tie strap with a portion of the strap and the specialized clasp shown in cross-section.

FIG. 8 is a side elevational view of the present invention flexible tie strap with a portion of the strap and the specialized clasp shown in cross-section, with the strap drawn tightly around a group of objects.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 1, there is shown at 10 the present invention flexible tie strap with specialized clasp. The tie strap 20 is shown in greater detailed in the cross-sectional view of FIG. 2. The strap 20 is made of flexible material, preferably plastic or thermoplastic and is essentially a continuous strip of material 22 having a multiplicity of evenly spaced apart transverse openings or holes 24. The openings or holes 24 extends entirely through the thickness of the strip of material 22 and adjacent openings 24 are separated by sections of material 22. While the openings 24 are shown as generally rectangular, it will be appreciated that any other configuration for the openings 24 such as square, oval, etc. are within the spirit and scope of the present invention. The strap 20 has a first face 26 and a second face 30. First face 26 is smooth and the entire face lies in the same plane. Second face 30 has a pair of ridges, a first ridge 32 and a second ridge 34 running along the entire length of the strip of material 22 at opposite edges. A recessed section 36 of face 30 extends between the two ridges 32 and 34 and surrounds the opening 24 on second face 30.

FIGS. 3 through 6 illustrate in detail the specialized clasp of the present invention. In the preferred embodiment, the overall shape of the clasp 40 is a pyramidal frustum with a wide edge 42 and a narrow edge 44. The frustum clasp 40 also has a top wall 46 including an interior surface 48 which are slanted from the wide edge 42 to the narrow edge 44 and bottom wall 50 including an interior surface 52 which are also slanted from the wide edge 42 to the narrow edge 44. The clasp 40 also has first side wall 54 and second side wall 56. The clasp is hollow and an interior chamber is formed by the top wall 46, the bottom wall 50, the first side wall 54 and the second side wall 56. Supported by and between first and second side walls 54 and 56 is an internal partition wall 60. Internal partition wall 60 is supported midway between top wall 46 and bottom wall 50 and divides the interior chamber into two separate chambers, an upper chamber 62 and a lower chamber 64.

Extending inwardly from interior surface 48 of top wall 46, beginning at a location adjacent wide edge 42 and extending at a angle toward the partition wall 60 is first gripping member 70. First gripping member 70 comprises a base section 72, a narrower stem section 74 and a still narrower tip section 76. The first gripping member is attached to the interior surface 48 of top wall 46 and extends at an angle angle relative to the interior surface 48 with its tip 76 pointing toward internal partition wall 60. The tip 76 terminates at a distance D above internal partition wall 60. The distance D is large enough to permit the flexible strap 20 to pass between the first gripping member 70 and the internal partition wall 60. However, since the tip 76 of first gripping member 70 must be locked within an opening 24, the distance D is smaller than the overall thickness T (see FIG. 8) of strap 20. Therefore, the stem portion 74 of first gripping member 70 must be flexible so that it can bend upwardly towardly interior surface 48 as the strap 20 is threaded through clasp 40 and then snap back into place after the desired opening 24 in strap 20 has been reached.

Similarly, extending inwardly from interior surface 52 of bottom wall 50, beginning at a location adjacent wide edge 42 and extending at a angle toward the partition wall 60 is second gripping member 80. Second gripping member 80 comprises a base section 82, a narrower stem section 84 and a still narrower tip section 86. The second gripping member 80 is attached to the interior surface 52 of bottom wall 50 and extends at an angle relative to the interior surface 52 with its tip 86 pointing toward internal partition wall 60. The tip 86 terminates at a distance D' above internal partition wall 60. The distance D' is large enough to permit the flexible strap 20 to pass between the second gripping member 80 and the internal partition wall 60. However, since the tip 86 of second gripping member 80 must be locked within an opening 24, the distance D' is smaller than the overall thickness T (see FIG. 8) of strap 20. Therefore, the stem portion 84 of second gripping member 80 must be flexible so that it can bend downwardly toward interior surface 52 as the strap 20 is threaded through clasp 40 and then snap back into place after the desired opening 24 in strap 20 has been reached.

While any desired angle A between first gripping member 70 and surface 48 which is less than 90 degrees could work, the preferred range for angle A is approximately 10 degrees to 75 degrees. Similarly, while any desired any B between second gripping member 80 and surface 48 which is less than 90 degrees could work, the preferred range for angle B is approximately 10 degrees to 75 degrees.

The present invention is shown in operation in FIGS. 7 and 8. Referring to FIG. 7, the first portion 21 of strap 20 is threaded through the clasp 40 by inserting the first section portion 21 into the wide end 42 and into upper chamber 62 of clasp 42 such that the strap 20 is guided between internal partition wall 60 and the tip 76 of first gripping member 70. In the preferred orientation, second face 30 of strap 20 faces the internal partition wall 60 such that the ridges 32 and 34 elevate the strap 20 above the partition wall and provide more strap surface for tip 76 when it intersects the desired opening 24. Since the stem 74 of first gripping member 70 is flexible, it can be pushed toward surface 48 as the desired length of strap 20 is threaded through clasp 40. After the desired length is reached, the tip 76 is allowed to set within an opening 24. As can be seen from FIG. 7, it is not possible to reverse the movement of the strap since the angle of first gripping member 70 causes the tip 76 to be firmly embedded in opening 24 and against the wall material 22 serving as the circumference of the opening 24. However, the strap 20 can be further pulled through the clasp if desired since the angle of first gripping member 70 permits further movement in the insertion direction until the first gripping member 70 is snapped into the next desired opening 24.

The balance of the strap 20 is then wound around the group of objects 100, which by way of example only can be a bundle of wires, such that the loop area 90 entraps the objects 100 within the loop area 90 between the strap 20 and the wide end 42 of clasp 40. The second end 23 of strap 20 is then threaded through the clasp 40 by inserting the second section portion 23 into the wide end 42 and into lower chamber 64 of clasp 40 such that the strap 20 is guided between internal partition wall 60 and the tip 86 of second gripping member 80. In the preferred orientation, second face 30 of strap 20 faces the internal partition wall 60 such that the ridges 32 and 34 elevate the strap below the partition wall 60 and provide more strap surface for tip 86 when it intersects the desired opening 24. Since the stem 84 of second gripping member 80 is flexible, it can be pushed toward surface 52 as the desired length of strap 20 is threaded through clasp 40. After the desired length is reached, the tip 86 is allowed to set within an opening 24. As can be seen from FIG. 7, it is not possible to reverse the movement of the strap since the angle of second gripping member 80 causes the tip 86 to be firmly embedded in opening 24 and against the wall material 22 serving as the circumference of the opening 24. However, the strap 20 can be further pulled through the clasp if desired since the angle of second gripping member 80 permits further movement in the insertion direction until the second gripping member 80 is snapped into the next opening 24.

As illustrated in FIG. 8, both portions 21 and 23 of strap 20 can be pulled through clasp 40 until the bundle of objects 100 is tightly bound together. The objects have been shown as large in order to more clearly illustrate the tieing capability of the present invention. One additional feature of the present invention is that if the objects 100 have a very thin cross-section, such as thin wire, they can still be bound tightly together because the loop 90 can be made very small and the strap 20 pulled at both portions 21 and 23 until the strap 20 is almost flush with rear end 42 of clasp 40.

While the preferred mode is to insert the strap 20 within the clasp 40 such that the second face with protrusions 32 and 34 face the interior partition wall 60, it is within the spirit and scope of the present invention to insert the strap 20 such that the first face 26 with the smooth surface faces the interior partition wall 60.

While the preferred shape of the clasp 40 is a pyramidal frustum as discussed above, it is also within the spirit and scope of the present invention for the clasp to be square or rectangular.

The present invention has significant advantages over the device of the Andre Patent No. 4,680,824 ("Andre Patent") in that a partition wall in the clasp prevents the two ends of the strap from coming in contact with each other. In the Andre Patent, the two smooth ends of the strap contact each other and it is easy for the grip to slip and the loop to become loose since one strap can slide against the other strap. In addition, in the Andre patent, the tongues are on the strap and it is easy for tongues to break off as they are pulled through the clasp, thereby further creating areas where the strap tie can become loose. It is also easier for the sliding strap to come loose from the internal teeth in the clasp or locking piece in the Andre patent.

The present invention can be defined as an apparatus for tieing, comprising: (a) an elongated flexible strap member comprising a multiplicity of openings along its longitudinal centerline and extending transversely therethrough along its length; (b) said elongated flexible strap member further comprising a first surface which is smooth and a second surface having a pair of oppositely disposed ridges extending along both edges of the second face for the entire length of the elongated flexible strap member; (c) a separate clasp member further comprising a hollow housing having a first side wall, a second side wall, a top wall, a bottom wall and an internal partition wall supported by the first and second side walls and located midway between the top wall and the bottom wall to thereby divide the interior of the clasp member into an upper chamber and a lower chamber with openings extending out the rear end and front end of the clasp member; (d) said clasp member formed in the shape of a pyramidal frustum with the rear end being larger than the front end; (e) a first flexible gripping member affixed to the interior of said top wall at a location adjacent the rear end of the clasp and extending within said upper chamber at an oblique angle relative to said top wall and terminating at a location above said interior partition wall sufficient to permit said elongated flexible strap member to pass between the tip of said first gripping member and said interior partition wall; and (f) a second flexible gripping member affixed to the interior of said bottom wall at a location adjacent the rear end of the clasp and extending within said lower chamber at an oblique angle relative to said bottom wall and terminating at a location below said interior partition wall sufficient to permit said elongated flexible strap member to pass between the tip of said second gripping member and said interior partition wall; (g) whereby a first end of said elongated flexible strap member can be inserted into the clasp from its rear opening and into the upper chamber such that the second surface is adjacent the internal partition wall and the elongated flexible strap member is threaded through the front end of the clasp member and is retained therein in an irreversible manner by the insertion of the tip of said first flexible gripping member into one of said multiplicity of openings in said elongated flexible strap member and a second end of said elongated flexible strap member is inserted into the clasp from its rear opening and into the lower chamber such that the second surface is adjacent the internal partition wall and the elongated flexible strap member is threaded through the front end of the clasp member and is retained therein in an irreversible manner by the insertion of the tip of said second flexible gripping member into one of said multiplicity of openings in said elongated flexible strap member and the section of strap member protruding from the rear of the clasp forms a loop to tie objects together.

The first flexible gripping member further comprises a base section attached to the interior of said top wall, a narrower stem section, and a still narrow tip section which fits within one of said multiplicity of openings in said elongated flexible strap member; and the second flexible gripping member further comprises a base section attached to the interior of said bottom wall, a narrower stem section, and a still narrow tip section which fits within one of said multiplicity of openings in said elongated flexible strap member.

The angle between said first flexible gripping member and the top wall is in the range between 10 degrees and 75 degrees; and the angle between said second flexible gripping member and the bottom wall is in the range between 10 degrees and 75 degrees.

The multiplicity of transverse openings in said elongated flexible strap member is rectangular.

Defined more broadly, the present invention is an apparatus for tieing, comprising: (a) an elongated flexible strap member comprising a multiplicity of openings along its longitudinal centerline and extending transversely therethrough along its length; (b) a separate clasp member further comprising a hollow housing having a first side wall, a second side wall, a top wall, a bottom wall and an internal partition wall supported by the first and second side walls and located midway between the top wall and the bottom wall to thereby divide the interior of the clasp member into an upper chamber and a lower chamber with openings extending out the rear end and front end of the clasp member; (c) a first flexible gripping member affixed to the interior of said top wall at a location adjacent the rear end of the clasp and extending within said upper chamber at an oblique angle relative to said top wall and terminating at a location above said interior partition wall sufficient to permit said elongated flexible strap member to pass between the tip of said first gripping member and said interior partition wall; and (d) a second flexible gripping member affixed to the interior of said bottom wall at a location adjacent the rear end of the clasp and extending within said lower chamber at an oblique angle relative to said bottom wall and terminating at a location below said interior partition wall sufficient to permit said elongated flexible strap member to pass between the tip of said second gripping member and said interior partition wall; (e) whereby a first end of said elongated flexible strap member can be inserted into the clasp from its rear opening and into the upper chamber such that the elongated flexible strap member is adjacent the internal partition wall and the elongated flexible strap member is threaded through the front end of the clasp member and is retained therein in an irreversible manner by the insertion of the tip of said first flexible gripping member into one of said multiplicity of openings in said elongated flexible strap member and a second end of said elongated flexible strap member is inserted into the clasp from its rear opening and into the lower chamber such that the elongated flexible strap member is adjacent the internal partition wall and the elongated flexible strap member is threaded through the front end of the clasp member and is retained therein in an irreversible manner by the insertion of the tip of said second flexible gripping member into one of said multiplicity of openings in said elongated flexible strap member and the section of strap member protruding from the rear of the clasp forms a loop to tie objects together.

Therefore, through use of the present invention, a flexible tieing apparatus is achieved by incorporating the concept of an endless flexible strap which can be cut to any desired length combined with a novel clasp member which can be irreversibly locked into two locations on the strap to form a tight loop around the objects to be tied.

While the present invention irreversible tie strap has been shown in its bundling application, it can also be used to fasten two pieces together in place of screws or rivets. It can also be used as an attaching apparatus such as attaching the identification tag to luggage and other objects.

Both the strap material and the clasp should be made of flexible material. Plastic material such as thermoplastics are the preferred material from which the strap and the clasp is made. The material should have good axial resistance. It must be chemically resistant to grease, mineral oils, gasoline and some solvents. Metal and other materials can also be used for the material oft he strap and the clasp. For special operations, a metallic belt for the strap, extruded or laminated, can be employed.

The present invention facilitates easy automation of the entire process of production since the flexible strap is continuous and can be cut to any desired rolled lengths and inserted automatically in the dispenser. The flexible strap can also be loaded into a special dispensing gun for deployment and also can be loaded into special automatic assembly machines since the straps can be regulated to any length and the clasp attached. For automatic assembly operations, it is certainly within the spirit and scope of the present invention to wind the flexible strap around the object to be tied first and then attach the clasp at the two ends of the strap, as previously described.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for tieing, comprising:

a. an elongated flexible strap member comprising a multiplicity of openings along its longitudinal centerline and extending transversely therethrough along its length;

b. said elongated flexible strap member further comprising a first surface which is smooth and a second surface having a pair of oppositely disposed ridges extending along both edges of the second face for the entire length of the elongated flexible strap member;

c. a separate clasp member further comprising a hollow housing having a first side wall, a second side wall, a top wall, a bottom wall and an internal partition wall supported by the first and second side walls and located midway between the top wall and the bottom wall to thereby divide the interior of the clasp member into an upper chamber and a lower chamber with openings extending out the rear end and front end of the clasp member;

d. said clasp member formed in the shape of a pyramidal frustum with the rear end being larger than the front end;

e. a first flexible gripping member affixed to the interior of said top wall at a location adjacent the rear end of the clasp and extending within said upper chamber at an oblique angle relative to said top wall and terminating at a location above said interior partition wall sufficient to permit said elongated flexible strap member to pass between the tip of said first gripping member and said interior partition wall; and f. a second flexible gripping member affixed to the interior of said bottom wall at a location adjacent the rear end of the clasp and extending within said lower chamber at an oblique angle relative to said bottom wall and terminating at a location below said interior partition wall sufficient to permit said elongated flexible strap member to pass between the tip of said second gripping member and said interior partition wall;

g. whereby a first end of said elongated flexible strap member can be inserted into the clasp from its rear opening and into the upper chamber such that the second surface is adjacent the internal partition wall and the elongated flexible strap member is threaded through the front end of the clasp member and is retained therein in an irreversible manner by the insertion of the tip of said first flexible gripping member into one of said multiplicity of openings in said elongated flexible strap member and a second end of said elongated flexible strap member is inserted into the clasp from its rear opening and into the lower chamber such that the second surface is adjacent the internal partition wall and the elongated flexible strap member is threaded through the front end of the clasp member and is retained therein in an irreversible manner by the insertion of the tip of said second flexible gripping member into one of said multiplicity of openings in said elongated flexible strap member and the section of strap member protruding from the rear of the clasp forms a loop to tie objects together.

2. An apparatus in accordance with claim 1 wherein:

a. said first flexible gripping member further comprises a base section attached to the interior of said top wall, a narrower stem section, and a still narrow tip section which fits within one of said multiplicity of openings in said elongated flexible strap member; and b. said second flexible gripping member further comprises a base section attached to the interior of said bottom wall, a narrower stem section, and a still narrow tip section which fits within one of said multiplicity of openings in said elongated flexible strap member.

3. An apparatus in accordance with claim 1 wherein:

a. the angle between said first flexible gripping member and the top wall is in the range between 10 degrees and 75 degrees; and b. the angle between said second flexible gripping member and the bottom wall is in the range between 10 degrees and 75 degrees.

4. An apparatus in accordance with claim 1 wherein said elongated flexible strap is made of plastic and said clasp is made of plastic.

5. An apparatus in accordance with claim 1 wherein said elongated flexible strap member is made of metal and said claps is made of metal.

6. An apparatus in accordance with claim 1 wherein said elongated flexible strap member is wound into a roll.

7. An apparatus in accordance with claim 6 wherein said roll of elongated flexible strap member is inserted into a cartridge dispenser.

8. An apparatus in accordance with claim 1 wherein each of said multiplicity of transverse openings in said elongated flexible strap member is rectangular.

9. An apparatus for tieing, comprising:

a. an elongated flexible strap member comprising a multiplicity of openings along its longitudinal centerline and extending transversely therethrough along its length;

b. a separate clasp member further comprising a hollow housing having a first side wall, a second side wall, a top wall, a bottom wall and an internal partition wall supported by the first and second side walls and located midway between the top wall and the bottom wall to thereby divide the interior of the clasp member into an upper chamber and a lower chamber with openings extending out the rear end and front end of the clasp member;

c. a first flexible gripping member affixed to the interior of said top wall at a location adjacent the rear end of the clasp and extending within said upper chamber at an oblique angle relative to said top wall and terminating at a location above said interior partition wall sufficient to permit said elongated flexible strap member to pass between the tip of said first gripping member and said interior partition wall; and d. a second flexible gripping member affixed to the interior of said bottom wall at a location adjacent the rear end of the clasp and extending within said lower chamber at an oblique angle relative to said bottom wall and terminating at a location below said interior partition wall sufficient to permit said elongated flexible strap member to pass between the tip of said second gripping member and said interior partition wall;

e. whereby a first end of said elongated flexible strap member can be inserted into the clasp from its rear opening and into the upper chamber such that the elongated flexible strap member is adjacent the internal partition wall and the elongated flexible strap member is threaded through the front end of the clasp member and is retained therein in an irreversible manner by the insertion of the tip of said first flexible gripping member into one of said multiplicity of openings in said elongated flexible strap member and a second end of said elongated flexible strap member is inserted into the clasp from its rear opening and into the lower chamber such that the elongated flexible strap member is adjacent the internal partition wall and the elongated flexible strap member is threaded through the front end of the clasp member and is retained therein in an irreversible manner by the insertion of the tip of said second flexible gripping member into one of said multiplicity of openings in said elongated flexible strap member and the section of strap member protruding from the rear of the clasp forms a loop to tie objects together.

10. An apparatus in accordance with claim 9 wherein said clasp is in the shape of a pyramidal frustum with the rear end being larger than the front end.

11. An apparatus in accordance with claim 9 wherein:

a. said first flexible gripping member further comprises a base section attached to the interior of said top wall, a narrower stem section, and a still narrow tip section which fits within one of said multiplicity of openings in said elongated flexible strap member; and b. said second flexible gripping member further comprises a base section attached to the interior of said bottom wall, a narrower stem section, and a still narrow tip section which fits within one of said multiplicity of openings in said elongated flexible strap member.

12. An apparatus in accordance with claim 9 wherein:

a. the angle between said first flexible gripping member and the top wall is in the range between 10 degrees and 75 degrees; and b. the angle between said second flexible gripping member and the bottom wall is in the range between 10 degrees and 75 degrees.

13. An apparatus in accordance with claim 9 wherein said elongated flexible strap is made of plastic and said clasp is made of plastic.

14. An apparatus in accordance with claim 9 wherein said elongated flexible strap member is made of metal and said clasp is made of metal.

15. An apparatus in accordance with claim 9 wherein said elongated flexible strap member further comprises a first surface which is smooth and a second surface having a pair of oppositely disposed ridges extending along both edges of the second face for the entire length of the elongated flexible strap member.

16. An apparatus in accordance with claim 9 wherein said elongated flexible strap member is wound into a roll.

17. An apparatus in accordance with claim 16 wherein said roll of elongated flexible strap member is inserted into a cartridge dispenser.

18. An apparatus in accordance with claim 9 wherein each of said multiplicity of transverse openings in said elongated flexible strap member is rectangular.

* * * * *